US005161712A

United States Patent [19]

Olson

[11] Patent Number: 5,161,712

[45] Date of Patent: Nov. 10, 1992

[54] NO-SPRING POP-UP NOTE DISPENSER

[76] Inventor: David V. Olson, 929 Medical Arts Bldg., Minneapolis, Minn. 55402

[21] Appl. No.: 798,613

[22] Filed: Nov. 26, 1991

[51] Int. Cl.[5] ..... A47K 10/24

[52] U.S. Cl. ..... 221/45; 221/48; 206/494

[58] Field of Search ..... 221/45, 48, 33, 51, 221/56, 58, 55, 63, 131; 206/494, 449, 812

[56] References Cited

U.S. PATENT DOCUMENTS 3,369,698 2/1968 Scholz ..... 221/48
4,623,074 11/1986 Dearwester ..... 221/48
4,706,844 11/1987 Omdoll et al. ..... 221/45

*Primary Examiner*—Robert P. Olszewski
*Assistant Examiner*—Kenneth Noland
*Attorney, Agent, or Firm*—Burd, Bartz & Gutenkauf

[57] ABSTRACT

A no-spring pop-up dispenser for sequential delivery of rectangular self-stick removable notes from a fan-folded pad of such notes. The dispenser comprises a flat rectangular base wall, end walls connected along one edge to one of the opposite parallel end edges of the base wall, and top walls connected to the tops of the end walls and having an open slot between spaced apart edges of the top walls. The dispenser is characterized by a pad of notes held between the end walls being forced into an upward bowed configuration. The top walls are spaced from the base wall and extend angularly inwardly and upwardly in general conformity to the top of the bowed pad of notes. Preferably the dispenser is formed from paperboard and is provided with front and back walls. Fastening tabs are provided projecting from the front and back edges of the top walls foldably connected and in engagement with respective front and back walls of the dispenser.

16 Claims, 2 Drawing Sheets

NO-SPRING POP-UP NOTE DISPENSER

BACKGROUND OF THE INVENTION

1. FIELD OF THE INVENTION

This invention relates to a no-spring pop-up dispenser for sequential delivery of rectangular self-stick removable notes from a fan-folded pad of such notes. Self-stick removable notes are sheets of paper having a narrow band of a relatively lightly adhering pressure sensitive adhesive along one edge of the back surface of the paper. Such self-stick removable notes in many sizes, colors and configurations are widely distributed by the 3M Company of St. Paul, Minn. and sold under the brand name POST-IT. POST-IT brand notes are almost universally available in thousands of variety stores, drug stores, supermarkets, office supply stores, by mail order, and the like throughout the world such that they are one of the best known consumer products available on the market. Fan-folded notes have the adhesive strip applied to alternate parallel edges of the stacked note paper sheets comprising the pad, and such fan-folded pads are readily available for use with pop-up dispensers.

2. THE PRIOR ART

One form of pop-up note dispenser distributed by the 3M Company comprises a rectangular cardboard box whose length and width correspond generally to those of a fan-folded pad of notes such that the pad fits with a loose fit within the box. A transverse slot is provided in the center of the top of the box. The free unattached end of the topmost note sheet extends through that slot and permits the pad sheets to be withdrawn sequentially as needed. The depth of this dispenser box is substantially greater than the thickness of the fan-folded pad of notes to be dispensed. The reason for this is that a relatively large diameter helical compression coil spring is required to be packaged within the dispenser under the pad of notes to urge the pad upward so that the topmost sheet is at all times readily accessible through the slot in the top of the box.

Another form of dispenser sold by the 3M Company is in the form of a bracket having a base with an arcuate inner surface, a pair of end walls and a pair of arcuate top wall members spaced apart from the arcuate inner wall by a distance permitting insertion of a note pad therein. The ends of the top wall members are spaced apart to provide an opening through which the topmost note sheet is delivered. Although the note pad must be bowed in order to insert it into this form of dispenser, a spring-loaded plunger is required to maintain the pad in engagement with the inside top wall adjacent the opening. It should be noted that the end walls of the space defined within the bracket diverge slightly from the arcuate inner wall toward the inside surface of the top wall.

These prior art pop-up note dispensers are unnecessarily complicated because of the requirement for spring pressure to maintain the note pad in operable position for dispensing the note sheets, especially as the pad nears exhaustion. It is the principal object of the present invention to provide a simplified pop-up note dispenser which does not require the presence of a spring.

SUMMARY OF THE INVENTION

In its simpliest form the no-spring pop-up dispenser for sequential delivery of rectangular self-stick removable notes from a fan-folded pad of such notes comprises a rectantular base wall slightly shorter than the length of the removable notes to be dispensed, a pair of end walls each connected along one edge to one of the opposite parallel end edges of the base wall, a pair of top walls each connected along one edge to the opposite edge of one of the end walls, and an open slot between the spaced apart edges of the top walls. The dispenser is characterized by the width of the end walls corresponding generally to the thickness of the fan-folded pad of notes to be dispensed, and the end walls preferably being inclined angularly inwardly and upwardly toward one another. A pad of notes held between the end walls is forced into an upward bowed configuration. The top walls extend angularly inwardly and upwardly relative to the base wall and spaced apart therefrom, and the width of each of the top walls is less than one-half the length of the base wall so as to provide the required open slot. This minimum structure requires that the dispenser be formed from a rigid material into an integral rigid unit, as defined.

Preferably, however, the dispenser is formed from an inexpensive disposable paperboard material and is provided additionally with front and back walls each foldably connected at right angles along one edge of one of the parallel front and back edges of the base wall, having end edges conforming to the end walls and top edges extending angularly inwardly and upwardly conforming to the top walls. The end walls and the top walls are connected to the front and rear walls, preferably be means of fastening tabs projecting from the front and back edges of the top walls, foldably connected thereto and in engagement with the respective front and back walls of the dispenser.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
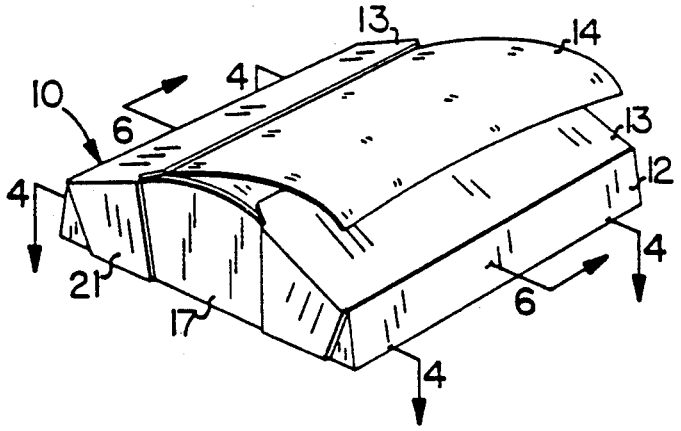
FIG. 1 is a perspective view of the dispenser.
Figure 2:
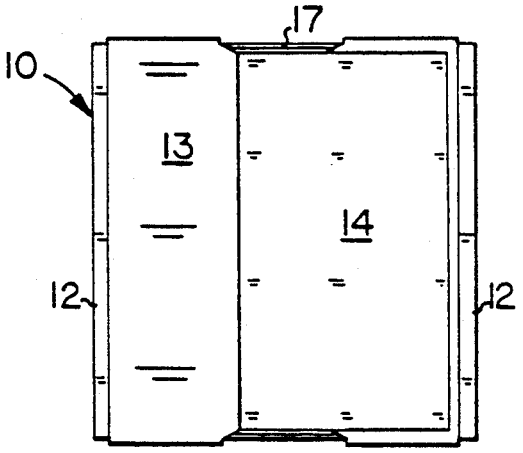
FIG. 2 is a top plan view of the dispenser.
Figure 3:
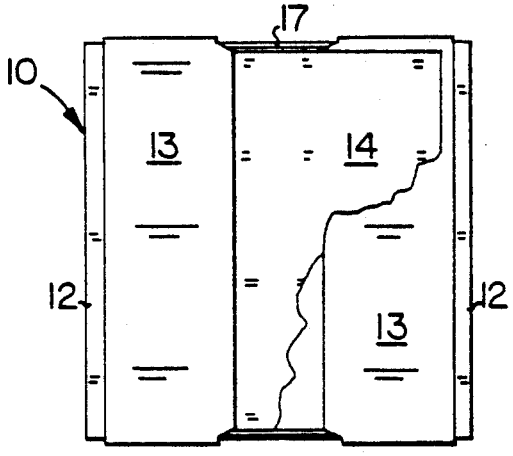
FIG. 3 is a similar top plan view partially broken away to reveal underlying structure.
Figure 4:
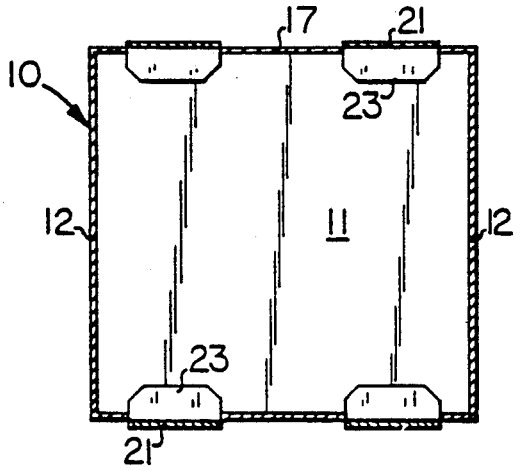
FIG. 4 is a section on the line 4—4 of FIG. 1 and in the direction of the arrows showing the inside bottom base wall of the dispenser.
Figure 5:
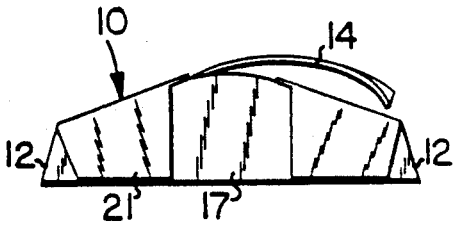
FIG. 5 is a front elevation of the dispenser.
Figure 6:
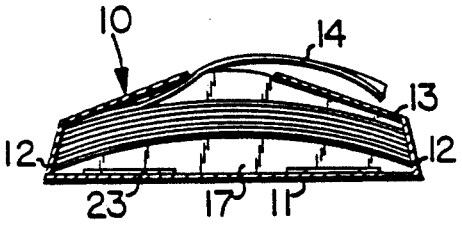
FIG. 6 is a section on the line 6—6 of FIG. 1 and in the direction of the arrows.
Figure 7:
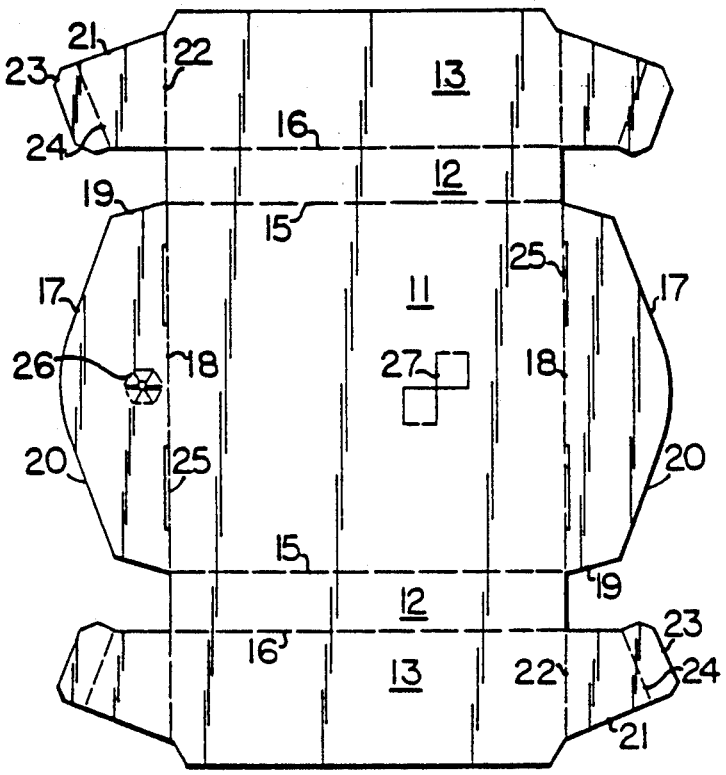
FIG. 7 is a plan view of a paperboard blank from which the dispenser may be formed.

Referring now to the drawings, the dispenser box is indicated generally at 10. The dispenser box 10 includes as essential elements a bottom or base wall 11, a pair of end walls 12 each connected along one edge to one of the opposite parallel end edges of the base wall 11, and a pair of top walls 13 each connected along one edge to the opposite edge of one of the end walls 12. The base wall 11 is rectangular and is slightly shorter than the length of the removable notes 14 to be dispensed, by about 3/32 to 5/32 inch, preferably about ⅛ inch. Where the dispenser is a closed box, then the base wall is wide enough to receive a pad of the note sheets loosely therein.

Where the dispenser is formed from paperboard from a die-cut blank as shown in FIG. 7, end walls 12 are connected to base wall 11 along fold lines 15 and are connected to top walls 13 along fold lines 16. The end walls 12 may extend upwardly at right angles. However, preferably, as best seen in FIGS. 5 and 6, the end walls 12 extend upwardly from the base wall 11 and are inclined angularly inwardly and upwardly toward one another at an angle between about 70 to 75 degrees. The width of the end walls corresponds generally to the thickness of the fan-folded pad of notes to be dispensed. As seen in FIG. 6, the shortened base wall 11 and inclined end walls 12 cause the pad of notes held between the walls to be forced into an upward bowed configuration. This eliminates the need for a coil spring within the dispenser package and ensures that the pad of notes will be urged upwardly for delivery of the topmost sheet until the pad is exhausted.

Top walls 13 extend angularly inwardly toward one another and slightly upwardly. They overlie and are spaced from the base wall 11 and extend upwardly at an angle of about 15 to 20 degrees relative thereto. The width of each top wall 13 is less than one-half the length of the base wall 11 so as to provide an open dispensing slot between the parallel edges of the top walls. The topmost sheet 14 of the fan-folded pad of note sheets extends through the dispensing slot at all times, the free end of the sheet alternately extending in one direction and then in the opposite direction.

According to one form of the invention base wall 11, end walls 12 and top walls 15 may be formed of rigid material in a single unitary rigid structure. In this instance front and back walls are not required to maintain the end walls and top walls in position relative to one another and to the base wall and pads of notes can readily be inserted. Such rigid structures may be formed, for example, from stainless steel, aluminum, brass, rigid synthetic resinous plastic, and the like by molding or extruding, etc.

When the dispenser is formed from paperboard, however, then front and back walls 17 are provided, connected along fold lines 18 to base wall 11. The front and back walls are folded to extend at right angles from the base member. The end edges 19 of the front and back walls preferably are inclined angularly inwardly and upwardly corresponding to the similar angular inclination of the end walls with which they abut. The top edges 20 of the front and back walls are inclined angularly inwardly and upwardly corresponding to the similar angular inclination of the top walls with which they abut.

The abutting edges may be secured, for example, by use of adhesive. Or, alternatively, when the dispenser box is formed from sheet material such as paperboard, fastening tabs may be provided projecting from the front and back edges of the top walls 13. The first portion 21 of the fastening tabs are connected along fold lines 22 to the front and back edges of each top wall. Where the dispenser box is intended to be used but once, fastening tab portions 21 may be adhesively secured to the outside or inside surfaces of front and back walls 17. However, where the dispenser box is intended for repeated usage by insertion of a replacement pad of notes when the earlier pad has become exhausted, then the fastening tabs are provided with a second tab portion 23 connected along fold line 24 to the first tab portion 21. These second tab portions 23 are removably inserted in slots 25 formed along the fold lines 18 between base wall 11 and end walls 17. When it is desired to replace a pad of notes, tab portions 23 on either the front or the back of the box are removed from slots 25, tab portions 21 are folded up generally in alignment with the surfaces of top walls 13, wall 17 is folded downwardly in alignment with the surface of base wall 11 and a replacement pad can readily be inserted, after which the front or back of the dispenser box is reassembled for further use.

Figure 8:
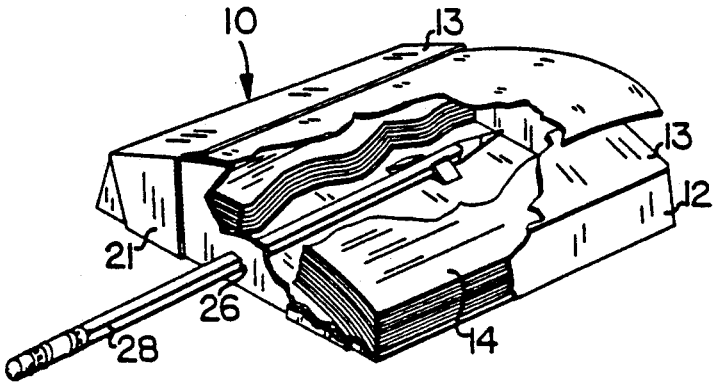
FIG. 8 is a perspective view, partly broken away to reveal interior structure, and showing an optional pen-holding feature of the dispenser.

Optionally, a central circular aperture 26 may be die-cut or otherwise formed in either of front or back walls 17 adjacent to the fold line between the base wall 11 and front or back wall 17. A pair of spaced apart guide elements in the form of tabs 27 are similarly formed in the base wall 11. Tabs 27 may be folded inwardly to project upwardly from the base wall to provide a guide in general alignment with aperture 26. A writing utensil in the form of a pencil 28 or pen, or the like, may then be inserted in the dispenser box as shown in FIG. 8.

As an alternative form of construction, the dispenser box 10 may be formed by molding from an appropriate synthetic resinous plastic material. Side walls 12, top walls 13 and front and back walls 17 may be formed as a one-piece plastic shell in the bottom of which a flat rectangular base wall may be secured, after insertion of a pad of fan-folded notes, with a snap fit or by means of adhesive, or heat seal, or equivalent means.

However formed, the dispenser in each instance functions in the same manner without the need for a spring to urge the topmost note sheet against the dispensing slot. In each instance, the free end of the topmost pad sheet is passed through the dispensing slot. The inwardly sloping end walls 12 ensure that the pad remains in upwardly bowed configuration. As each pad sheet is sequentially removed, the next underlying sheet, to which the topmost sheet is lightly adhesively secured, is pulled through the dispensing slot and the notes are separated, all of this occurring substantially instantaneously.

References to "front," "back," "upwardly," and the like are relative and are made with respect to the dispenser as illustrated in the drawings. The dispenser may be used on a horizontal surface or, where convenient, it may be mounted on a vertical wall surface.

The dispenser may be as decorative or as plain and utilitarian as desired. In the latter instance the dispenser box may be used as a replacement cartridge for insertion into other more expensive and decorative permanent type outer boxes or shells. For example, a paperboard box full of notes may be inserted into a cowling-type fixture.

It is apparent that many modifications and variations of this invention as hereinbefore set forth may be made without departing from the spirit and scope thereof. The specific embodiments described are given by way of example only. The invention is limited only by the terms of the appended claims.

I claim:

1. A no-spring pop-up dispenser for sequential delivery of rectangular self-stick removable notes from a fan-folded pad of such notes, said dispenser comprising:

A) a rectangular base wall shorter by about 3/32 to 5/32 inch than the length of the removable notes to be dispensed, B) a pair of end walls each connected along one edge to one of the opposite parallel end edges of the base wall, the width of said end walls corresponding generally to the thickness of the fan-folded pad of notes to be dispensed, whereby a pad of notes held therebetween is forced into an upward bowed configuration, C) a pair of top walls each connected along one edge to the opposite edge of one of the end walls and extending angularly inwardly and upwardly relative to the base wall and spaced therefrom, the width of each of said top walls being less than one-half the length of the base wall, and D) an open slot between the spaced apart edges of said top walls.

2. A dispenser according to claim 1 wherein the end walls are inclined angularly inwardly and upwardly toward one another.

3. A dispenser according to claim 2 wherein said base wall is approximately the width of the removable notes to be dispensed.

4. A dispenser according to claim 3 wherein:

A) said dispenser is composed essentially of paperboard,

B) a pair of front and back walls are each foldably connected at right angles along one edge to one of the opposite parallel front and back edges of the base wall, the end edges of the front and back walls being inclined angularly inwardly and upwardly corresponding to the orientation of the end walls and the top edges being inclined angularly inwardly and upwardly corresponding to the orientation of the top walls.

5. A dispenser according to claim 4 wherein fastening tabs are provided projecting from the front and back edges of the top walls, foldably connected thereto and in engagement with the front and back walls of the dispenser.

6. A dispenser according to claim 5 wherein each of said fastening tabs is adhesively secured to the front and back walls in face-to-face abutment therewith.

7. A dispenser according to claim 5 wherein each of said fastening tabs includes a first portion in engagement with the respective front and back walls in face-to-face abutting relation and a second portion inserted into a slot at the fold line between the base wall and front and rear walls.

8. A dispenser according to claim 4 wherein a central circular aperture is formed in at least one of said front and back walls adjacent to the fold line between the base wall and front or back wall, and a pair of spaced apart guide elements is provided projecting upwardly from the base wall in alignment with said aperture.

9. In combination, a dispenser according to claim 1 and a pad of fan-folded self-stick removable notes contained therein, one edge of the topmost of said notes extending through said open slot.

10. In combination, a dispenser according to claim 5 and a pad of fan-folded self-stick removable notes contained therein, one edge of the topmost of said notes extending through said open slot.

11. A no-spring pop-up dispenser for sequential delivery of rectangular self-stick removable notes from a fan-folded pad of such notes, said dispenser consisting essentially of paperboard and comprising:

A) a flat rectangular base wall of length about 3/32 to 5/32 inch shorter and corresponding in width to the removable notes to be dispensed, B) a pair of end walls, 1) each of said end walls being foldably connected along one edge to one of the opposite parallel end edges of the base wall, and 2) the width of said end walls corresponding generally to the thickness of the fan-folded paid of notes to be dispensed, whereby a pad of notes held therebetween is forced into an upward bowed configuration, C) a pair of top walls, 1) each of said top walls being foldably connected along one edge to the opposite edge of one of the end walls, 2) the width of each of said top walls being less than one-half the length of the base wall, and 3) the top walls extending angularly inwardly and upwardly relative to the base wall and spaced therefrom, D) an open slot between the spaced apart edges of the top walls, E) a pair of front and back walls, 1) each of said front and back walls being foldably connected at right angles along one edge to one of the opposite front and back edges of the base wall, 2) the end edges of the front and back walls being in abutment with the front and back edges of said end walls, and 3) the top edges of the front and back walls being inclined angularly inwardly and upwardly and in abutment with the front and back edges of said top walls, and F) fastening tabs projecting from the front and back edges of the top walls, foldably connected thereto and in abutting engagement with the respective front and back walls of the dispenser.

12. A dispenser according to claim 11 wherein the end walls are inclined angularly inwardly and upwardly toward one another.

13. A dispenser according to claim 11 wherein each of said fastening tabs is adhesively secured to the front and back walls in face-to-face abutment therewith.

14. A dispenser according to claim 11 wherein each of said fastening tabs includes a first portion in engagement with the respective front and back walls in face-to-face abutting relation and a second portion inserted into a slot at the fold line between the base wall and front and back walls.

15. A dispenser according to claim 11 wherein a central circular aperture is formed in at least one of said front and back walls adjacent to the fold line between the base wall and front or back wall, and a pair of spaced apart guide elements is provided projecting upwardly from the base wall in alignment with said aperture.

16. In combination, a dispenser according to claim 11 and a pad of fan-folded self-stick removable notes contained therein, one edge of the topmost of said notes extending through said open slot.

* * * * *